US008672579B2

(12) United States Patent
Laiho et al.

(10) Patent No.: US 8,672,579 B2
(45) Date of Patent: Mar. 18, 2014

(54) EXPANSION JOINT SYSTEM OF CONCRETE SLAB ARRANGEMENT

(75) Inventors: Topi Laiho, Lahti (FI); Trent Davis, Plymouth (GB)

(73) Assignee: Peikko Group Oy, Lahti (FI)

( * ) Notice: Subject to any disclaimer, the term of this patent is extended or adjusted under 35 U.S.C. 154(b) by 217 days.

(21) Appl. No.: 12/812,297

(22) PCT Filed: Jan. 20, 2009

(86) PCT No.: PCT/FI2009/050053

§ 371 (c)(1),
(2), (4) Date: Aug. 13, 2010

(87) PCT Pub. No.: WO2009/092860

PCT Pub. Date: Jul. 30, 2009

(65) Prior Publication Data

US 2010/0325995 A1 Dec. 30, 2010

(30) Foreign Application Priority Data

Jan. 21, 2008 (FI) ..... 20085048

(51) Int. Cl.
*E01C 11/14* (2006.01)
*E01D 19/06* (2006.01)

(52) U.S. Cl.
CPC ..... *E01C 11/14* (2013.01); *E01D 19/06* (2013.01)
USPC ..... 404/47; 407/57; 407/58; 407/59; 407/60

(58) Field of Classification Search
CPC ..... E01C 11/14; E01D 19/06; E01D 19/65
USPC ..... 404/47–67
See application file for complete search history.

(56) References Cited

U.S. PATENT DOCUMENTS 2,150,982 A 3/1939 McFarland
2,316,233 A * 4/1943 Fischer ..... 404/60

(Continued)

FOREIGN PATENT DOCUMENTS

FI 110631 B 2/2003
GB 1188292 4/1970
WO WO 2006/123176 A1 11/2006

OTHER PUBLICATIONS

Finnish Search Report dated Nov. 3, 2008 in Finnish Patent Application No. 20085048 (with translation).

(Continued)

*Primary Examiner* — Raymond W Addie
(74) *Attorney, Agent, or Firm* — Oliff PLC

(57) ABSTRACT

Expansion joint system of a concrete slab arrangement, comprising an expansion joint reinforcement to be arranged between a first and a second concrete slab (1, 2), the expansion joint reinforcement comprising at least two local dowels (3)transferring loads perpendicular to the slab plane. The dowels comprise a dowel plate (4) and a casing part (5). The dowel plate (4) and the casing part (5) are attached to the concrete slabs on different sides of the joint. The casing part (5) prevents the dowel plate from adhering to the concrete slab and allows the dowel plate (4) to move inside the casing part and thus allows the movements of the slabs (1, 2) in the horizontal direction. The dowels (3) are installed alternately relative to the joint so that the casing parts (5) of the adjacent dowels (3) are always installed on different sides of the joint.

11 Claims, 3 Drawing Sheets

(56) References Cited

U.S. PATENT DOCUMENTS

| | | | | |
|---|---|---|---|---|
| 2,580,163 | A | 12/1951 | Fischer | |
| 5,363,619 | A * | 11/1994 | McPhee | 52/367 |
| 5,674,028 | A * | 10/1997 | Norin | 404/74 |
| 6,354,760 | B1 | 3/2002 | Boxall et al. | |
| 6,926,463 | B2 | 8/2005 | Shaw et al. | |
| 7,228,666 | B2 * | 6/2007 | Michiels | 52/396.05 |
| 7,381,008 | B2 * | 6/2008 | Shaw et al. | 404/60 |
| 7,716,890 | B2 * | 5/2010 | Boxall et al. | 52/396.02 |
| 7,967,528 | B2 * | 6/2011 | Mercer et al. | 404/60 |
| 2005/0036835 | A1 | 2/2005 | Shaw et al. | |
| 2006/0140721 | A1 | 6/2006 | Shaw et al. | |

OTHER PUBLICATIONS

International Search Report dated May 18, 2009 in International Application No. PCT/FI2009/050053.

International Preliminary Report on Patentability dated Apr. 19, 2010 in International Application No. PCT/FI2009/050053.

* cited by examiner b > a
A > A' b > a
A > A'

A > A'

EXPANSION JOINT SYSTEM OF CONCRETE SLAB ARRANGEMENT

The invention relates to an expansion joint system of a concrete slab arrangement, comprising an expansion joint reinforcement to be arranged between a first and a second concrete slab, the expansion joint reinforcement comprising at least two local dowels which are arranged to transfer loads perpendicular to the slab plane and which comprise a dowel plate and a casing part having a shape matching with the dowel plate, whereby the dowel plate and the casing part are arranged to be attached to the concrete slabs on different sides of the joint, and whereby the casing part is arranged to prevent the dowel plate from adhering to the concrete slab and further arranged to allow the dowel plate to move inside the casing part and thus to allow the movements of the slabs in the horizontal direction.

Expansion joint reinforcements are mainly used in connection with ground slab arrangements. Ground slab arrangements are structures formed of concrete slabs and cast directly in place for example upon a sand bed on the construction site.

It is preferable to make the slabs used in ground slab arrangements as thin as possible, whereby the consumption of concrete remains as small as possible.

The slabs of ground slab arrangements are supported against the ground. Although the ground under the slab is made as compact as possible, its load-carrying capacity is not uniform. Therefore, even a thin ground slab must be capable of dividing point load, for example, over a wider area so that no local dents are generated in the slab. Due to this, a ground slab is usually provided with a steel wire net to be installed halfway of its thickness. The wire net also evens out the stresses caused by the shrinking of the slab.

Usually it is necessary to cover relatively large areas by means of ground slab arrangements. Due to the shrinkage and thermal movements of concrete, large areas must be divided into smaller parts with expansion joints. An expansion joint must allow adjacent slabs of the arrangement to move horizontally relative to each other due to shrinkage and thermal movements. These movements mean here movements that are in the direction of the joint and perpendicular to the joint. In contrast, vertical movements perpendicular to the slab plane must be prevented, in other words the joint must be capable of transferring vertical load between the slabs of a slab arrangement.

The joint points are the weakest parts in slab arrangements because a slab is not capable of dividing a load at the edge over a wide area in the ground. In other words, local dents may be generated. Another significant aspect is splitting of the slab edge, for example under a wheel load.

The structures in the joint must also stay in place, i.e. stay adhered to the concrete even if the surrounding concrete wore down or split. This shows particularly when wheel loads are directed at the joint.

Before the expansion joint reinforcements presently on the market, it was, for example, sawing of a large cast slab into smaller parts after casting that was used. However, sawing was slow and expensive, and the edges of the joint would also break up.

A second example of the above-mentioned old techniques is the use of angle irons to be pressed into the cast after sawing. Disadvantages of this technique were its slowness, high costs, and also determination of the right timing so that the concrete would not harden too much, in other words it was difficult to know whether the angle iron would still adhere to the concrete and stay there in load situations.

A third example is the use of through tenons, i.e. bars to be installed at the edge of a concrete cast. The intention was to reduce adhesion at one end of the bars, for example by means of bituminization. However, a disadvantage was the slow installation in the mould because it was necessary to make holes in the mould. There was also the problem of high costs and, in addition, practical difficulties in installing, for instance due to the fact that the bars had to be exactly parallel so as not to prevent the shrinking movements of the slab.

To eliminate problems of the above solutions, a wide variety of expansion joint reinforcement solutions differing from each other have been provided in the field. Examples of expansion joint solutions known in the field include solutions based on the use of local steel dowels. In such solutions, the local steel dowel transfers loads between slabs. There are usually several dowels in the direction of the joint, whereby the dowels are arranged at a distance from each other in the direction of the joint. The dowel plates of these local dowels are often of a tapering shape as one moves farther away from the joint. On one side of the expansion joint, the tapering dowel plate is isolated by means of a casing part made of plastic material, for example, to prevent it from adhering to the concrete. Correspondingly, on the other side of the expansion joint no casing part is used and the dowel plate adheres to the concrete. When the slabs are shrinking, the dowel plate moves inside the casing part and subsequently allows the movements of the slab also in the longitudinal direction of the joint.

Examples of the above solutions are disclosed in U.S. Pat. Nos. 6,354,760, 6,926,463 and FI patent publication 110631.

A disadvantage of the above solutions is that the area of the cross-section of the dowel is reduced at the edge of the slab, on the side of that slab where the dowel plate can move. The load transfer capacity of the dowel is dependent on the extent of the dowel cross-section at the edge of the slab. Another disadvantage of the above solution is that the dowel area loading the concrete is reduced at the edge of the slab, on the side of that slab where the dowel plate can move. The durability of the concrete at the point of the dowel is dependent on the area of the dowel. Also dowels which do not taper as one moves farther away from the joint have this disadvantage.

An object of the invention is to provide an expansion joint system of a concrete slab arrangement by means of which disadvantages of the prior art can be eliminated. This has been achieved by means of an expansion joint system of a concrete slab arrangement according to the invention, characterized in that the dowels are arranged to be installed alternately relative to the joint in such a way that the casing parts of the adjacent dowels are arranged to be always installed on different sides of the joint.

An advantage of the invention is that when the slabs are shrinking, the total capacity of the dowels is the same at the edge of both slabs. A further advantage of the invention is the same total durability at the point of the dowels at the edges of both slabs. Also, an advantage of the invention is its simplicity, which means that the introduction and use of the invention are preferable.

In the following, the invention will be explained in greater detail with reference to the examples illustrated in the attached drawing, whereby FIGS. 1 and 2 show a principled view of the cross-section and area of a dowel plate being reduced at the edge of a slab when the slabs are shrinking;

Figure 1:
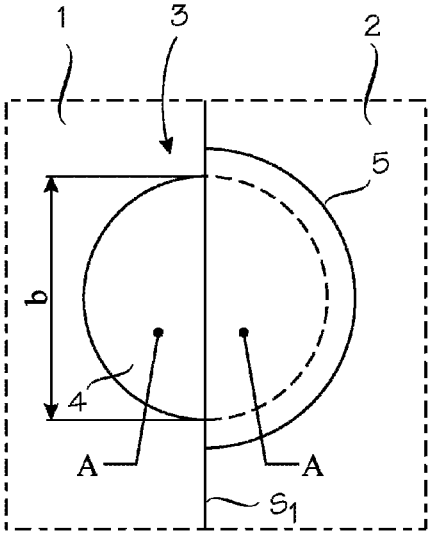

FIGS. 1 to 4 show a principled view of the cross-section and area of the dowel plate of the dowel being reduced when the concrete slabs are shrinking. A first concrete slab in FIGS. 1 to 4 is denoted with reference numeral 1 and a second concrete slab correspondingly with reference numeral 2. The dowel is denoted with reference numeral 3. The dowel 3 comprises a dowel plate 4 and a casing part 5.

The dowel 3 and associated structures are only shown in principle in FIGS. 1 to 4. It is obvious to a person skilled in the art that a real structure comprises various additional structures.

The expansion joint is denoted with reference numeral S1 in FIG. 1.

As seen from FIG. 1, the dowel plate 4 has a certain cross-section at the expansion joint S1, denoted with index number b. As mentioned above, the load transfer capacity of the dowel is dependent on the extent of the dowel cross-section at the edge of the slab. The dowel areas loading the concrete are shown in the figure by means of index numbers A.

Figure 2:
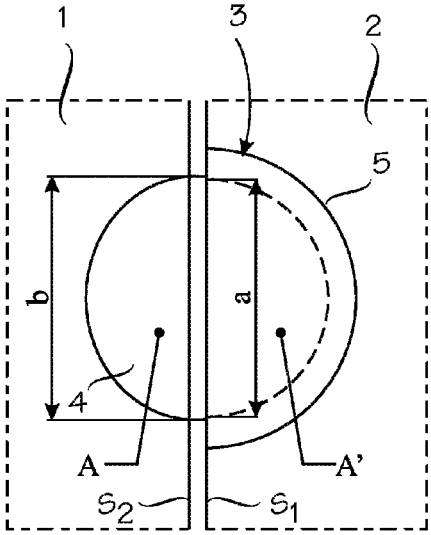

When the slabs are shrinking, the situation changes, in other words the dowel plate 4 moves inside the casing part 5, as set forth earlier. The changed situation is illustrated in FIG. 2. FIG. 2 shows a situation where the cross-section of the dowel plate 4 at the edge of that slab relative to which the dowel moves is indicated with index number a. FIG. 2 indicates the slab edges with reference numerals S1 and S2. For comparison, FIG. 2 also includes index number b. As seen from FIGS. 1 and 2, b>a, i.e. the cross-section of the dowel plate is smaller in FIG. 2 than in FIG. 1, in other words the load transfer capacity of the dowel plate is smaller in FIG. 2 than in FIG. 1. The dowel areas loading the concrete are shown with the aid of index numbers A and A' in FIG. 2, i.e. A>A' in this case.

The above aspects are based on the fact that when the cross-section of the dowel is reduced, the load transfer capacity of the dowel is also reduced. This becomes a dominating property particularly in the portion of thicker slabs more intensely loaded, where the capacity of the dowel has a greater significance. Likewise, in cases where the slab is reinforced in such a way that the durability of the concrete around the dowel is increased, the area of the dowel cross-section has a great significance. Also the dowel area loading the concrete of the slab has a great significance, as noted above.

Figure 3:
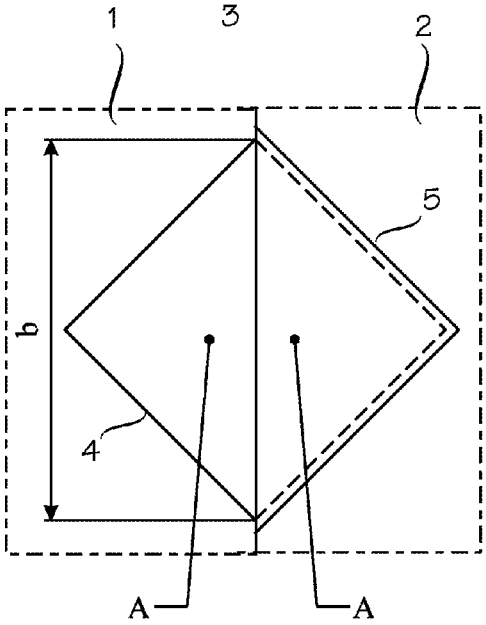
FIGS. 3 and 4 show a principled view of the cross-section and area of another kind of dowel plate being reduced at the edge of a slab when the slabs are shrinking.
Figure 4:
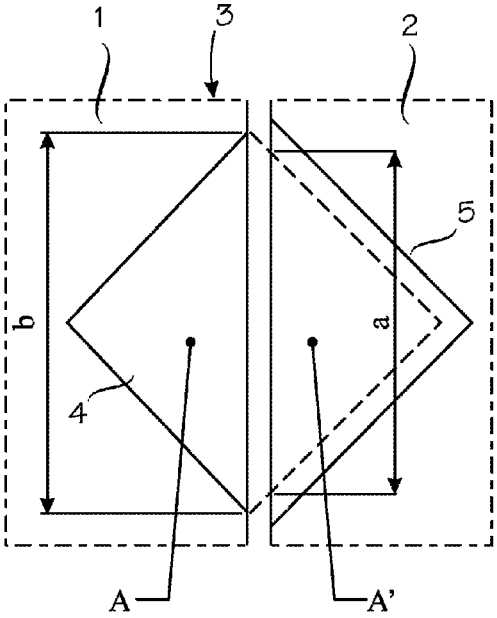

FIGS. 1 and 2 show a solution where the shape of the dowel plate is substantially round. FIGS. 3 and 4 show a solution using a quadrangular dowel plate. In the example of FIGS. 3 and 4, the reduction of the cross-section of the dowel plate when the slabs are shrinking is completely similar to that in the example of FIGS. 1 and 2.

The above dowel solutions are, as such, completely conventional technology to a person skilled in the art, and thus reference is here made to the patent publications mentioned earlier, such as FI patent publication 110631.

The prior art dowel solutions are implemented in such a way that the dowels are always arranged in the same way, in other words all dowel plates of the dowels of the expansion joint are attached to, for example, the first concrete slab, and all casing parts of the dowels are correspondingly attached to the second concrete slab. Such a solution is disclosed in FI patent publication 110631, for instance. This kind of known solution leads to the disadvantages described earlier.

Figure 5:
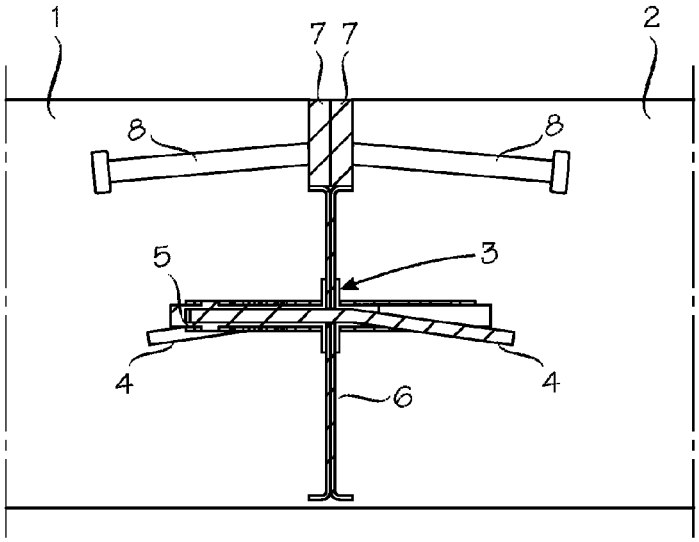
FIG. 5 shows an expansion joint provided by means of an embodiment of an expansion joint system of concrete slabs according to the invention, seen from the direction of the joint.
Figure 6:
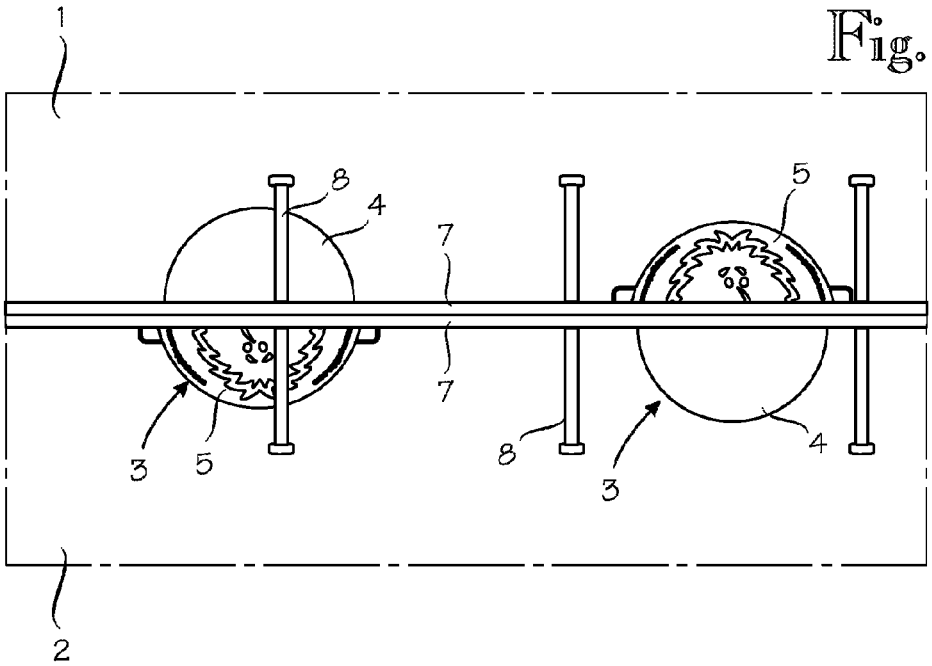
FIG. 6 shows a top view of the expansion joint according to FIG. 5.

FIGS. 5 and 6 show an embodiment of an expansion joint system of a concrete slab arrangement according to the invention. Reference numeral 1 shows a first concrete slab, reference numeral 2 showing correspondingly a second concrete slab. Reference numeral 3 indicates a dowel comprising a dowel plate 4 and a casing part 5.

In the example of FIGS. 5 and 6, reference numeral 6 denotes a plate part to which the dowels are attached, reference numeral 7 denoting a reinforcement arranged at the upper edge of the slab and also comprising a horizontal reinforcement part 8.

The structure according to FIGS. 5 and 6 is achieved in such a way that the entity formed by the plate part 6, dowels 3 and reinforcements 7, 8 is arranged in a mould before casting, whereby the plate part forms the edge of the mould and thus the expansion joint. Hence, concrete is cast on both sides of the plate part 3, which results in concrete slabs 1 and 2 as well as an expansion joint between them. After the casting stage, the dowels adhere to the concrete, as noted before. These aspects are known to a person skilled in the art.

In accordance with an essential idea of the invention, the dowels 3 are arranged to be installed alternately relative to the joint in such a way that the casing parts 5 of the adjacent dowels 3 are arranged to be always installed on different sides of the joint. The above solution is clearly seen from FIG. 2, where, starting from the left, the casing part 5 of the first dowel 3 is on the side of the concrete slab 2 and, as one moves to the right, the casing part of the next dowel 3 is on the side of the concrete slab 1.

By means of the above solution, the total capacity of the dowels in the expansion joint remains the same at the edge of both concrete slabs. The disadvantages of the known solutions are due to the capacity of the dowels being reduced at the edge of one slab. Further, it is to be noted that in the present solution the total dowel area loading the concrete is not reduced on one side of the joint in a slab shrinking situation, as it does in known solutions, whereby the prior art disadvantage relating to dowel areas loading the concrete is eliminated.

However, the dowels do not have to be fixed to the expansion joint reinforcement but they may also be individually installed on the construction site, in other words the invention may also be applied in such a way that at first, only one slab is cast on the construction site and moulded with plywood, to which the casing parts are attached. After the cast has been hardened, the plywood is taken off, the casing parts being thus fixed to the cast, whereby dowels can be installed in them. After this, another slab can be cast. In accordance with an essential idea of the invention, a casing part and a dowel are fastened by turns to the first cast. Before casting the second slab, dowels are installed in the casings in the cast, and casing parts are installed in the dowels in the cast.

The invention is not restricted to any particular shape of a dowel plate but may be applied in connection with all kinds of dowels whose dowel plate width is at the greatest in the middle part of the dowel plate in the direction of the joint and whose width in the direction of the joint is reduced as one moves perpendicularly to the direction of the joint towards the edges of the dowel plate. The dowel plates may be, for example, plates with curved edges, for instance substantially round or substantially oval plates. The use of polygonal dowel plates is also feasible, for example quadrangular, hexagonal and octagonal plates etc.

Figure 7:
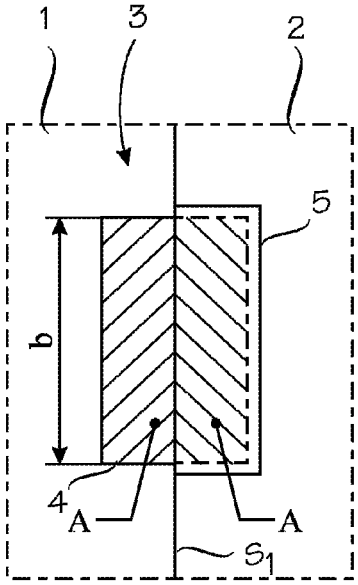
FIGS. 7 and 8 show a principled view of the area of a dowel plate being reduced at the edge of a slab when the slabs are shrinking.
Figure 8:
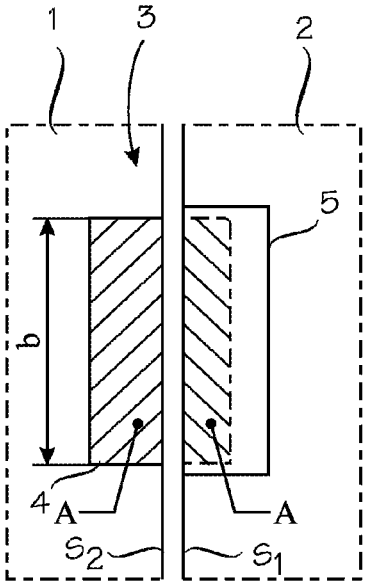

As noted above, the prior art also has the disadvantage that the dowel area loading the concrete is reduced at the edge of the slab, on the side of that slab where the dowel plate can move. This also applies to dowels which do not taper as one moves away from the joint. FIGS. 7 and 8 show how the area of a substantially rectangular dowel plate loading the concrete is reduced at the edge of the slab when the slabs are shrinking. FIGS. 7 and 8 use the same reference numerals at corresponding points as the previous figures. It can be seen from FIGS. 7 and 8 that A>A'.

The invention is thus not, by any means, restricted to the examples of the figures but other solutions are also feasible. The invention may be varied within the scope of the claims completely freely. The expansion joint reinforcements may naturally be different from those shown in the examples of the figures. Different plates, slabs, angle irons, ribbed bars etc. may naturally be used freely in expansion joint reinforcements, in the manner required in each particular case.

The invention claimed is:

1. An expansion joint system of a concrete slab arrangement including a first concrete slab and a second concrete slab that define a slab plane, an expansion joint reinforcement to be arranged between the first concrete slab and the second concrete slab, the expansion joint reinforcement comprising:

a first plate part to be arranged at a first slab edge of the first concrete slab so that the first plate part extends along the first slab edge of the first concrete slab and along a joint between the first concrete slab and the second concrete slab so that the first plate part faces the joint between the first concrete slab and the second concrete slab;

a second plate part to be arranged at a second slab edge of the second concrete slab so that the second plate part extends along the second slab edge of the second concrete slab and along the joint between the first concrete slab and the second concrete slab so that the second plate part faces the joint between the first concrete slab and the second concrete slab, the second plate part being separate from the first plate part, and the first plate part and the second plate part each extends alongside in the joint between the first concrete slab and the second concrete slab; and the first plate part and the second plate part being disposed so as to contact one another, and the first plate part and the second plate part extend in a same direction, the direction being perpendicular to the slab plane;

first local dowels which are arranged to transfer loads perpendicular to the slab plane and which comprise:

a first dowel plate, and a first casing part having a shape matching with the first dowel plate; and second local dowels which are arranged to transfer loads perpendicular to the slab plane and which comprise:

a second dowel plate, and a second casing part having a shape matching with the second dowel plate, wherein the first dowel plate and the first casing part are arranged to be cast into and to be attached to the concrete slabs on different sides of the joint, the first casing part is arranged to prevent the first dowel plate from adhering to a location of the concrete slabs where the first casing part is attached thereto, and the first casing part is further arranged to allow the first dowel plate to move inside the first casing part and thus to allow the movements of the concrete slabs in a horizontal direction, the second dowel plate and the second casing part are arranged to be cast into and to be attached to the concrete slabs on different sides of the joint, the second casing part is arranged to prevent the second dowel plate from adhering to a location of the concrete slabs where the second casing part is attached thereto, and the second casing part is further arranged to allow the second dowel plate to move inside the second casing part and thus to allow the movements of the concrete slabs in the horizontal direction, the first dowel plate and the first casing part are attached to the first plate part in an alternating order, and the second dowel plate and the second casing part are attached to the second plate part in an alternating order, in such a way that the first casing part and the second casing part are installed on different sides of the joint.

2. The expansion joint system of a concrete slab arrangement according to claim 1, wherein a width of the dowel plate of at least one of the first dowel or the second dowel is greatest in a middle part of the dowel plate in the direction of the joint, and the width in the direction of the joint is reduced as one moves perpendicularly to the direction of the joint towards the edges of the dowel plate.

3. The expansion joint system of a concrete slab arrangement according to claim 1, wherein the dowel plate of at least one of the first dowel or the second dowel has a shape of a plate with substantially curved edges.

4. The expansion joint system of a concrete slab arrangement according to claim 3, wherein the dowel plate of at least one of the first dowel or the second dowel is a round plate.

5. The expansion joint system of a concrete slab arrangement according to claim 1, wherein the dowel plate of at least one of the first dowel or the second dowel has a shape of a polygonal plate.

6. The expansion joint system of a concrete slab arrangement according to claim 1, wherein the dowel plate of at least one of the first dowel or the second dowel has a shape of a quadrangular or rectangular plate.

7. The expansion joint system of a concrete slab arrangement according to claim 1, wherein a first reinforcement profile is attached to an upper portion of the first plate part, and a second reinforcement profile is attached to an upper portion of the second plate part.

8. The expansion joint system of a concrete slab arrangement according to claim 7, wherein first reinforcement studs are attached to the first reinforcement profile and extend into the first concrete slab, and second reinforcement studs are attached to the second reinforcement profile and extend into the second concrete slab.

9. The expansion joint system of a concrete slab arrangement according to claim 1, wherein the first dowel plate is disposed within the first casing part.

10. An expansion joint system of a concrete slab arrangement including a first concrete slab and a second concrete slab that define a slab plane, an expansion joint reinforcement to be arranged between the first concrete slab and the second concrete slab, the expansion joint reinforcement comprising:

a first plate part to be arranged at a first slab edge of the first concrete slab so that the first plate part extends along the first slab edge of the first concrete slab and along a joint between the first concrete slab and the second concrete slab so that the first plate part faces the joint between the first concrete slab and the second concrete slab;

a second plate part to be arranged at a second slab edge of the second concrete slab so that the second plate part extends along the second slab edge of the second concrete slab and along the joint between the first concrete slab and the second concrete slab so that the second plate part faces the joint between the first concrete slab and the second concrete slab, the second plate part being separate from the first plate part, and the first plate part and the second plate part each extends alongside in the joint between the first concrete slab and the second concrete slab; and the first plate part and the second plate part being disposed so as to contact one another, and the first plate part and the second plate part extend in a same direction, the direction being perpendicular to the slab plane;

first local dowels which are arranged to transfer loads perpendicular to the slab plane and which comprise:

a first dowel plate, and a first casing part having a shape matching with the first dowel plate; and second local dowels which are arranged to transfer loads perpendicular to the slab plane and which comprise:

a second dowel plate, and a second casing part having a shape matching with the second dowel plate, wherein the first dowel plate and the first casing part are arranged to be cast into and to be attached to the concrete slabs on different sides of the joint, the first casing part is arranged to prevent the first dowel plate from adhering to a location of the concrete slabs where the first casing part is attached thereto, and the first casing part is further arranged to allow the first dowel plate to move inside the first casing part and thus to allow the movements of the concrete slabs in a horizontal direction, the second dowel plate and the second casing part are arranged to be cast into and to be attached to the concrete slabs on different sides of the joint, the second casing part is arranged to prevent the second dowel plate from adhering to a location of the concrete slabs where the second casing part is attached thereto, and the second casing part is further arranged to allow the second dowel plate to move inside the second casing part and thus to allow the movements of the concrete slabs in the horizontal direction, the first dowel plate and the first casing part are disposed on the first plate part in an alternating order, and the second dowel plate and the second casing part are disposed on the second plate part in an alternating order, in such a way that the first casing part and the second casing part are installed on different sides of the joint.

11. The expansion joint system of a concrete slab arrangement according to claim 10, wherein the first dowel plate is disposed within the first casing part.

* * * * *